US006062114A

United States Patent [19]

Rahm

[11] Patent Number: 6,062,114

[45] **Date of Patent: *May 16, 2000**

[54] POWER NUTRUNNER

[75] Inventor: Erik Roland Rahm, Hasselgatan, Sweden

[73] Assignee: Atlas Copco Tools AB, Nacka, Sweden

[ * ] Notice: This patent is subject to a terminal disclaimer.

[21] Appl. No.: 09/142,617

[22] PCT Filed: Mar. 11, 1997

[86] PCT No.: PCT/SE97/00408

§ 371 Date: Sep. 10, 1998

§ 102(e) Date: Sep. 10, 1998

[87] PCT Pub. No.: WO97/33721

PCT Pub. Date: Sep. 18, 1997

[30] Foreign Application Priority Data

Mar. 11, 1996 [SE] Sweden ..... 9600933

[51] Int. Cl.[7] ..... B25B 23/157

[52] U.S. Cl. ..... 81/473; 173/176

[58] Field of Search ..... 81/57.14, 473, 81/474, 475; 173/176, 178

[56] References Cited

U.S. PATENT DOCUMENTS

| | | | |
|---|---|---|---|
| 3,834,467 | 9/1974 | Fuchs . | |
| 4,834,192 | 5/1989 | Hansson . | |
| 4,842,078 | 6/1989 | Hansson . | |
| 4,898,249 | 2/1990 | Ohmori | 81/473 X |
| 5,076,120 | 12/1991 | Lin | 81/473 X |

*Primary Examiner*—James G. Smith
*Attorney, Agent, or Firm*—Frishauf, Holtz, Goodman, Langer & Chick, P.C.

[57] ABSTRACT

A power nutrunner has two consecutive planetary reduction gearings (12) and a torque limiting release clutch (13) disposed between a common ring gear (25) of the reduction gearings (12) and the tool housing (11). The ring gear (25) is tubular in shape and has an outer annular shoulder (41) at its one end carrying cam teeth (42) for cooperation with a spring biased thrust element (45) via balls (43) and cam surfaces (44). The thrust element (45) encircles the ring gear (25) and is rotationally locked relative to the housing (11) via a ball spline connection (47–49).

12 Claims, 1 Drawing Sheet

POWER NUTRUNNER

BACKGROUND OF THE INVENTION

The invention relates to a power nutrunner of the type having a planetary type reduction gearing and a torque limiting release clutch.

In particular, the invention concerns a power nutrunner in which the release clutch is disposed between a ring gear included in the reduction gearing, wherein a first cam means is provided on the ring gear, a second cam means is provided on an annular thrust element, two or more rolling elements are located between the thrust element and the ring gear to engage the first and second cam means, and a spring means is arranged to exert an axial bias load on the thrust element to maintain a torque transferring engagement between the first and second cam means.

A power nutrunner of the above type is previously described for instance U.S. Pat. No. 3,834,467. The nutrunner shown in this patent comprises a planetary reduction gearing having a rotatable but axially immovable ring gear, and a torque limiting release clutch including a spring biassed thrust element as well as cam means on the thrust element and the ring gear.

A significant feature of this known nutrunner is its relatively large axial dimensions. This is due to the fact that the release clutch including the thrust element is located axially separated from the ring gear. The result is a rather long tool housing. However, this is not a drawback in the type of tools illustrated in this patent, namely an angle nutrunner, because a long tool housing with a widely offset tool handle promotes an easier reaction torque counteraction by the operator.

In contrast to angle nutrunners, a straight pistol type tool need to be shorter in order to enhance a comfortable and effective handling of the tool as well as to reduce weight. The problem to which the invention is a solution arises when using this previously known type of reduction gearing/clutch mechanism in a pistol type tool. The axial dimension of the tool housing tends to be too large to meet the demands for a handy tool.

The main object of the invention is to provide a power nutrunner of the above described type in which the reduction gearing/clutch mechanism is axially very compact in order to keep down the overall lenght of the tool.

Other objects and advantages of the invention will appear prom the following specification and claims.

A preferred embodiment of the invention is below described in detail with reference to the accompanying drawing.

DETAILED DESCRIPTION

Figure 1:
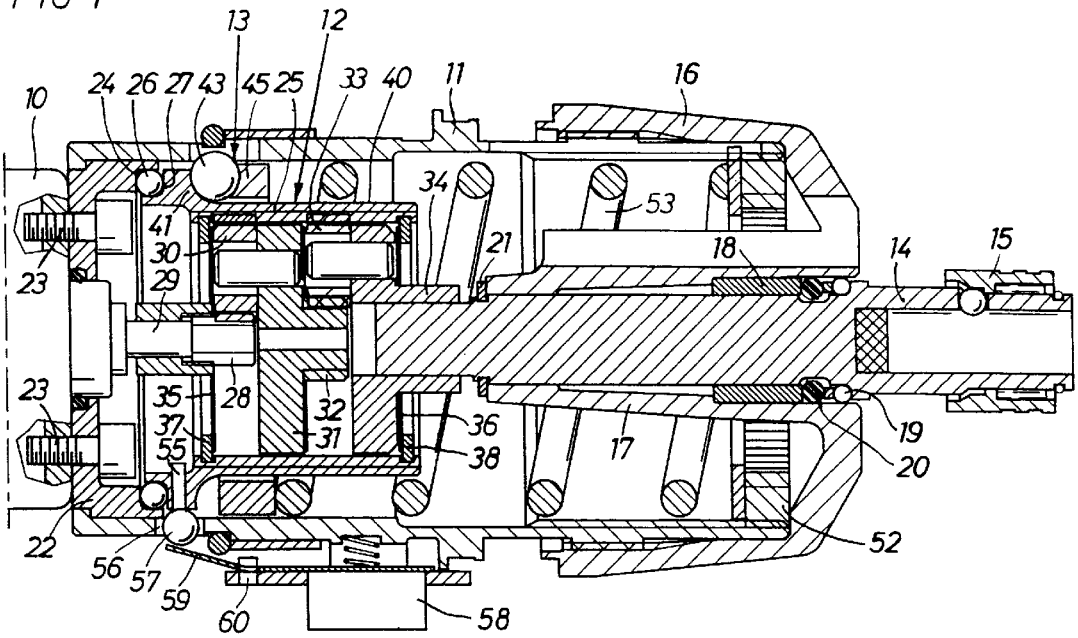
FIG. 1 shows a longitudinal section through the front part of a power nutrunner according to the invention.

The nutrunner illustrated in the drawing figures comprises a motor unit 10 the forward end portion only of which is shown in FIG. 1. Since the motor unit 10 does not form any part of the invention a detailed description thereof is not needed and is, therefore, left out of this specification.

To the motor unit 10 there is bolted a housing 11 for a reduction gearing 12 and a torque limiting release clutch 13. An output spindle 14 is connected to the motor unit 10 via the reduction gearing 12 and is provided with a chuck 15 for attachment of a screw joint engaging tool implement. At its forward end, the housing 11 is provided with an end wall 16 in which the output spindle 14 is rotationally journalled. The end wall 16 is formed with an internal neck portion 17 for providing a proper guidance for the output spindle 14. A bushing 18 at the front end of the end wall 16 forms a bearing for the output spindle 14 and is formed with an annular shoulder for transferring axial forces from the spindle 14 to the housing 11. A lock ring 19 and a shock absorbing resilient ring 20 are mounted on the spindle 14 for engagement with the shoulder of the bushing 18. In the opposite direction, the spindle 14 is axially locked by a lock ring 21 cooperating with the inner end of the end wall neck portion 17.

The rear end of the housing 11 comprises an end wall 22 which is secured to the motor unit 10 by means of screws 23. The end wall 22 is formed with a ball race 24 for rotational support of a tubular ring gear 25 via a number of balls 26 in cooperation with a ball race 27 on the ring gear 25.

The reduction gearing 12 comprises two consecutive planetary gearings for which the ring gear 25 is a common member. The planetary gearings comprise a sun gear 28 attached to the motor unit output shaft 29, a first set of planet wheels 30, a planet wheel carrier 31 formed integrally with a second sun gear 32, a second set of planet wheels 33, and a second planet wheel carrier 34 connected to the output spindle 14.

The planetary gearings are axially confined between two end washers 35, 36 supported by two lock rings 37, 38 secured to the ring gear 25.

Figure 3:
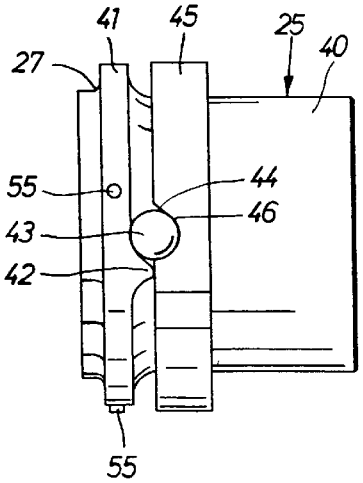
FIG. 3 shows a side elevation of the release clutch included in the power nutrunner shown in FIG. 1.
Figure 2:
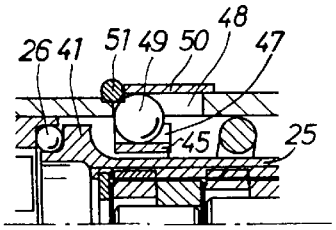
FIG. 2 stows a fractional section through the power nutrunner shown in FIG. 1 but located in a different plane

The ring gear 25 is substantially tubular in shape and has an outer cylindrical surface 40 and an annular shoulder 41. See FIG. 3. This shoulder 41 is provided with three axially directed and equally spaced cam teeth 42 which together with three bails 43 and three corresponding cam surfaces 44 on an annular thrust element 45 form the torque transferring clutch 13. These cam surfaces 44 are formed by three indentations 46 in the rear annular end surface of the thrust element 45. See FIG. 3.

The thrust element 45 is axially movable in the housing 11 but locked against rotation by means of a ball saline connection. The latter comprises three axially directed grooves 47 disposed on the outside of the thrust element 45, three slots 48 in the housing 11, and three balls 49 engaging the grooves 47 and the slots 48. A circular band 50 on the outside of the housing 11 retained by a lock ring 51 covers the slots 48, thereby preventing the balls 48 from falling out. The balls 49 are inserted from the outside of the housing 11 after removal of the lock ring 51 and sliding aside the band 50.

As illustrated in the drawing figures, the thrust element 45 has a larger diameter than the outer cylindrical surface 40 and encircles the latter. Accordingly, the thrust element 45 is located outside the ring gear 25 as is the rear end portion of a compression spring 53 which acts between the thrust element 45 and an adjustable support member 52 at the front end of the housing 11. The force developed by the spring 53 on the thrust element 45 exerts a bias load on the release clutch 13. This adjustable bias load together with the very shapes or the cam surfaces 44 and cam teeth 42 are determining for the torque level where the clutch releases.

At its rear periphery, the ring gear 25 is provided with three radially extending pins 55 disposes at equal angular distances from each other. In an aperture 56 in the housing i1 there is movably supported a ball 57, and on the outside of the housing 11 there is mounted a signal producing micro switch 58. A lever 59 pivoted about a stud 60 is arranged to transfer an activation movement from the ball 57 to the micro switch 58.

The micro switch 58 is connected to electronic control means for controlling the operation of the tool. These control means do not form any part of this invention and is, therefore, not described any further in this specification.

In operation of the nutrunner, the output spindle 14 is connected to a screw joint to be tightened via the chuck 15 and a tool implement attached thereto. Rotation power is supplied from the motor unit 10 via the shaft 29, and a speed reduction is obtained by the two consecutive planetary gearings before the rotation mower reaches the output spindle 14.

As the torque resistance from the screw joint increases, the reaction torque from the planetary gearings increases on the ring gear 25. This means that the ring gear 25 tends to start rotating, but is prevented from that by the clutch 13. The ring gear 25 remains stationary and the clutch continues to transfer the reaction torque from the ring gear 25 to the housing 11 as long as the bias load of the spring 53 is able to prevent the thrust element 45 from moving axially as a result of the interaction of the cam teeth 42, the balls 43 and cam surfaces 44.

As the intended release torque level of the clutch 13 is reached, however, the spring 53 yields to a point where the cam teeth 42 are able to pass over the balls 43 and the ring gear 25 is free to rotate relative to the thrust element 45 and the housing 11. The balls 43 remain in the indentations 46 in the thrust element 45 during the relative rotation between the ring gear 25 and the thrust element 45.

At rotation of the ring gear 25, at release point of the clutch 13, one of the pins 55 comes into engagement with the ball 57 to move the latter outwardly. This activation movement is transferred via the lever 59 to the micro switch 58 which delivers an electric signal to a control means for accomplishing shut-off of the nutrunner motor.

Each of the pins 55 is so located in relation to the cam teeth 42 that an activation of the micro switch 58 via the ball 57 and the lever 59 does not take place until the teeth 42 have reached or just passed the ton of the balls 43, i.e. when the torque transfer through the clutch has just ceased.

Depending on the actual rotational speed of the nutrunner motor and the other rotating parts of the tool at the shutoff point, the ring gear 20 continues to rotate some distance before coming to stand still. If the speed is high at the release point of the clutch 13, which is the case at tightening so called stiff screw joints, the ring gear cam teeth 42 will reach and even pass over the next ball engaging position before stopping. Since the motor is shut off at the first release position of the clutch, there is no driving torque to be transferred in the second ball engaging position of the gear ring 20, also is the kinetic energy of the rotating parts substantially decreased, which means that the second clutch engagement if any, does not cause any torque overshoot.

The above described nutrunner is intended to be powered by an electric motor with the micro switch connected to a motor voltage controlling means or any suitable kind. In particular, the invention is suitable for application on a battery powered nutrunner. In such a case, the motor control means is located on-board the tool.

However, the invention is not limited to a nutrunner having an electric motor, but could as well be applied on a nutrunner having a pneumatic motor. In such a case, the micro switch is connected to an external electric control unit by which a pressure air supply valve is controlled so as to obtain a timely shut-oft of the motor at release of the clutch 13.

I claim:

1. A power nutrunner, comprising:

a housing (11);

a rotation motor;

a reduction gearing (12) including at least one planetary gearing, said at least one planetary gear including a ring gear (25);

a torque limiting release clutch (13) arranged between the ring gear (25) of said at least one planetary gearing and said housing (11);

said ring gear (25) being rotatably but axially immovably supported relative to said housing (11) and provided with a first axially acting cam (42);

an annular axially movable thrust element (45) provided with a second cam (44);

a lock device (47–49) which rotationally locks said thrust element (45) relative to said housing (11);

a spring (53) arranged to exert an axial bias load on said thrust element (45); and at least two rolling elements (43) located between said thrust element (45) and said ring gear (25) so as to be engaged by said first and said second cams (42, 44) under said bias load;

wherein:

said ring gear (25) is substantially tubular in shape and has a cylindrical outer surface (40);

said thrust element (45) has a larger diameter than said ring gear (25) and encircles said cylindrical outer surface (40) of said ring gear (25); and said ring gear (25) has an annular shoulder (41) which extends radially outwardly from said cylindrical surface (40) and which comprises said first cam (42).

2. The power nutrunner according to claim 1, wherein said ring gear (25) includes:

a rotation detecting device (55);

a signal producing device (58) located on the outside of said housing (11); and an activation member (57) movably supported in a radial opening (56) in said housing (11) and arranged to transfer an activation movement from said rotation detecting device (55) to said signal producing device (58) at release of said clutch (13).

3. The power nutrunner according to claim 2, wherein:

said rotation detecting device (55) comprises at least one radially extending pin (55) rigidly secured to said ring gear (25); and said activation member (57) comprises a ball which is engaged on one side thereof by said at least one pin (55) and on another side thereof by said signal producing device (58).

4. The power nutrunner according to claim 1, wherein:

said at least one planetary gearing comprises at least two consecutive planetary gearings; and said ring gear (25) is common to said two consecutive planetary gearings.

5. The power nutrunner according to claim 2, wherein:

said at least one planetary gearing comprises at least two consecutive planetary gearings; and said ring gear (25) is common to said two consecutive planetary gearings.

6. The power nutrunner according to claim 3, wherein:

said at least one planetary gearing comprises at least two consecutive planetary gearings; and said ring gear (25) is common to said two consecutive planetary gearings.

7. The power nutrunner according to claim 1, wherein:

said lock device (47–49) comprises at least two axially directed grooves (47) on an outer periphery of said thrust element (45);

at least two axially extending grooves (48) in said housing (11); and at least two balls (49) engaging said grooves (48) on said thrust element (45) and said housing (11) to form a ball spline connection between said thrust element (45) and said housing (11).

8. The power nutrunner according to claim 2, wherein:

said lock device (47–49) comprises at least two axially directed grooves (47) on an outer periphery of said thrust element (45);

at least two axially extending grooves (48) in said housing (11); and at least two balls (49) engaging said grooves (48) on said thrust element (45) and said housing (11) to form a ball spline connection between said thrust element (45) and said housing (11).

9. The power nutrunner according to claim 3, wherein:

said lock device (47–49) comprises at least two axially directed grooves (47) on an outer periphery of said thrust element (45);

at least two axially extending grooves (48) in said housing (11); and at least two balls (49) engaging said grooves (48) on said thrust element (45) and said housing (11) to form a ball spline connection between said thrust element (45) and said housing (11).

10. The power nutrunner according to claim 4, wherein:

said lock device (47–49) comprises at least two axially directed grooves (47) on an outer periphery of said thrust element (45);

at least two axially extending grooves (48) in said housing (11); and at least two balls (49) engaging said grooves (48) on said thrust element (45) and said housing (11) to form a ball spline connection between said thrust element (45) and said housing (11).

11. The power nutrunner according to claim 5, wherein:

said lock device (47–49) comprises at least two axially directed grooves (47) on an outer periphery of said thrust element (45);

at least two axially extending grooves (48) in said housing (11); and at least two balls (49) engaging said grooves (48) on said thrust element (45) and said housing (11) to form a ball spline connection between said thrust element (45) and said housing (11).

12. The power nutrunner according to claim 6, wherein:

said lock device (47–49) comprises at least two axially directed grooves (47) on an outer periphery of said thrust element (45);

at least two axially extending grooves (48) in said housing (11); and at least two balls (49) engaging said grooves (48) on said thrust element (45) and said housing (11) to form a ball spline connection between said thrust element (45) and said housing (11).

* * * * *